US008029070B2

(12) United States Patent
McLain

(10) Patent No.: US 8,029,070 B2
(45) **Date of Patent: *Oct. 4, 2011**

(54) BUFFING BALL MADE OF COMPRESSIBLE MATERIAL

(75) Inventor: Scott S. McLain, Mukwonago, WI (US)

(73) Assignee: Lake Country Manufacturing, Inc., Hartland, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/704,091

(22) Filed: Feb. 11, 2010

(65) Prior Publication Data

US 2010/0141017 A1 Jun. 10, 2010

Related U.S. Application Data

(63) Continuation of application No. 11/077,058, filed on Mar. 10, 2005, now Pat. No. 7,669,939, which is a continuation-in-part of application No. 10/927,208, filed on Aug. 26, 2004, now Pat. No. 7,203,989.

(60) Provisional application No. 60/526,680, filed on Dec. 3, 2003.

(51) Int. Cl.
*A47L 13/16* (2006.01)
*B60S 3/06* (2006.01)

(52) U.S. Cl. ..... 300/21; 15/97.1

(58) Field of Classification Search ..... 300/21; 15/97.1, 97.3, 230.14, 230.17, 244.1; 264/162
See application file for complete search history.

(56) References Cited

U.S. PATENT DOCUMENTS

| | | | | |
|---|---|---|---|---|
| 1,819,800 | A | 8/1931 | Turner | |
| 2,004,623 | A | 6/1935 | Yohe | |
| 2,732,574 | A | 1/1956 | Gesell et al. | |
| 2,744,281 | A | 5/1956 | Zinnggeler | |
| 3,020,139 | A | 2/1962 | Camp et al | |
| 3,026,552 | A | 3/1962 | Price | |
| 3,204,277 | A | 9/1965 | Visman et al | |
| 4,177,611 | A | 12/1979 | Carr-Rollett | |
| 4,199,835 | A | 4/1980 | Heyer et al. | |
| 5,027,468 | A | 7/1991 | Leventhal et al. | |
| D353,940 | S | 1/1995 | Joyner et al. | |
| 5,938,515 | A | 8/1999 | McLain et al. | |
| 6,001,009 | A | 12/1999 | Kaiser et al. | |
| 6,044,512 | A | 4/2000 | Hornby et al. | |
| 6,081,959 | A | 7/2000 | Umbrell | |
| 7,203,989 | B2 * | 4/2007 | McLain | 15/244.1 |
| 7,669,939 | B2 * | 3/2010 | McLain | 300/21 |

OTHER PUBLICATIONS

2001 Flitz Polishing & Buffing Ball description and instruction information.

* cited by examiner

*Primary Examiner* — Laura C Guidotti
(74) *Attorney, Agent, or Firm* — Andrus, Sceales, Starke & Sawall, LLP

(57) ABSTRACT

A surface finishing ball of compressible material, adapted to be driven on a rotational axis is made from a layered body of compressible material that is formed in multiple disk-like layers that are separated in planes generally perpendicular to the rotational axis. Layers are also slit on circumferentially spaced planes that extend generally radially from an outside surface to define a plurality of foam fingers. A clamping system is used to compress and hold a center portion of the layered body in a direction along the axis of rotation such that the uncompressed outer ends of the fingers define a generally spherical ball.

8 Claims, 12 Drawing Sheets

BUFFING BALL MADE OF COMPRESSIBLE MATERIAL

CROSS-REFERENCE TO RELATED APPLICATION

This application is a continuation of U.S. patent application Ser. No. 11/077,058, filed Mar. 10, 2005, which is a continuation-in-art of U.S. patent application Ser. No. 10/927,208, filed Aug. 26, 2004, which was a conversion of U.S. Provisional Patent Application Ser. No. 60/526,680, filed Dec. 3, 2003.

BACKGROUND OF THE INVENTION

The present invention pertains to a rotary buffing or finishing device adapted to be attached to and driven by a powered operating tool or the like and, more particularly, to a buffing ball made at least partly of a plastic foam piece which is slit and compressed to form a ball for buffing, polishing and finishing a painted surface. Alternately, compressible non-foam materials may also be used.

Foam buffing pads are well known in the art and typically comprise circular, generally flat-faced pads attached to a circular backing plate which, in turn, is attached to a rotary or orbital powered operating tool. It is also known to make foam buffing pads by attaching a dense array of individual plastic foam fingers to a backing substrate such as is disclosed in U.S. Pat. No. 5,938,515. It is also known to make a buffing ball from a stack of thin circular layers of a cloth material, such as felt, that are slit radially inwardly from their outer edges and clamped axially such that the layers take on a somewhat spherical shape, when rotated, comprising an array of cloth fingers. The ball is mounted for rotation on the axis along which the cloth layers are pressed together to provide what is more accurately described as a buffing cylinder.

Because the prior art buffing ball is made of individual thin layers of cloth that are only slightly compressible and are stacked and clamped axially along the center axis, there is a tendency for relative rubbing movement between the layers which can result in fretting and wearing of the cloth. Also, because the individual layers are inherently thin, there is also a tendency for the fingers to tear more easily from the body of the cloth layer.

SUMMARY OF THE INVENTION

In accordance with one embodiment of the present invention, a buffing and polishing ball is made of a compressible polymeric foam material mounted to be driven on a rotational axis, the ball comprising a body of foam material that is slit in a substantially uncompressed state from an outside surface of the body in a direction generally perpendicular to the rotational axis, and further slit on circumferentially spaced planes that extend generally radially from the outside surface to define a plurality of foam fingers, and means for compressing and holding a center portion of the slit foam body in a direction along the axis such that the uncompressed outer ends of the fingers define a generally spherical ball. The slit that extends generally perpendicular to the rotational axis is preferably a single continuous spiral cut. In a preferred embodiment of the invention, the center portion of the foam body is unslit. Further, the spiral slit and the circumferentially spaced radially extending slits define fingers that, in the generally uncompressed state and after compression of the center portion, have rectangular outer ends. Preferably, the radially extending slits are cut to two depths that alternate circumferentially.

The buffing and polishing ball of the present invention also includes means for mounting the ball for rotation on its axis. The mounting means preferably comprises an integral extension of the compressing and holding means. In a presently preferred embodiment, the foam body is provided with a through bore that is coincident with the rotational axis, and the compressing and holding means comprises a two-headed fastener having heads larger than the bore, the heads of the fastener being connected together in the bore with the compressed center portion of the foam body surrounding the bore captured between the fastener heads. One fastener head comprises a driving head having a plurality of driving projections that are spaced radially outwardly of the axis of the bore and extend axially toward the other fastener head. A threaded stud is connected to one fastener head and extends along the bore toward the other fastener head. The other fastener head comprises a bearing head and has an inner face comprising a bearing plate that faces the first fastener head and a center opening for receipt of the threaded stud. A nut is threaded on the stud and is adapted to bear against an opposite outer face of the other fastener head. The foam body is also preferably provided with a plurality of axially extending bores for receipt of the driving projections. The nut comprises a threaded sleeve adapted to receive the threaded stud within a portion of the sleeve, and the arrangement further includes a threaded drive shaft that is received in a remaining portion of the sleeve.

In a preferred embodiment, the foam body has a cylinder shape with the rotational axis coinciding with the axis of the cylinder.

In an alternate embodiment, the spiral slit may be replaced by a series of slits in multiple axially spaced planes that extend generally perpendicular to the rotational axis. Both the perpendicularly extending slits and the radially extending slits extend into the foam body less than the distance to the rotational axis. Preferably, the radially extending slits extend about one-half the radius of the cylinder. The generally radially extending circumferentially spaced slits may be varied circumferentially to alternately comprise slits of different depths. In one embodiment, the depth of the radially extending, circumferentially spaced slits may vary between about 0.2 and about 0.4 times the radius.

Compressible materials other than polymeric foam may also be used to make a finishing ball in accordance with the present invention. Such alternate materials include non-woven polymeric matt materials, both with and without added abrasives, and natural and synthetic sponge materials. Furthermore, less compressible materials that would not be suitable alone to be formed into a finishing ball of the present invention may be utilized when alternated with layers of highly compressible material, such as polymeric foam.

Thus, the present invention contemplates a surface finishing ball made of compressible material comprising a layered body of such compressible material that is formed in multiple disk-like layers that are separated in planes generally perpendicular to the rotational axis. The layers are slit on circumferentially spaced planes that extend generally radially from an outside surface to define a plurality of foam fingers. Means are provided for compressing and holding a center portion of the layered body in a direction along the rotational axis such that the uncompressed outer ends of the fingers define a generally spherical ball.

In one embodiment, the disk-like layers are formed of alternating layers of different materials. In another embodiment, the disk-like layers are made of materials having different compressibilities. In yet another embodiment, the disk-like layers comprise alternating layers of materials having different diameters. The compressible material at the center portion of the layered body should have a ratio of thickness in an uncompressed state to a thickness in a compressed state of at least 5:1.

In one embodiment of a method of making a surface finishing ball of compressible material, the method includes the steps of forming a body of compressible material from multiple disk-like layers that are separated at least partially from an outside surface radially inwardly in planes generally perpendicular to a rotational axis, slitting the layers on circumferentially spaced planes that extend generally radially from the outside surface of the layered body to define a plurality of fingers, and compressing and holding a center portion of the layered body in a direction along the axis such that the uncompressed outer ends of the fingers define a generally spherical ball.

One embodiment of the foregoing method comprises the step of forming the disk-like layers from individual alternating layers of materials of different compressibilities. Another embodiment of the foregoing method comprises the step of forming the disk-like layers from individual alternating layers of two different diameters. A further embodiment of the foregoing method comprises the step of forming the disk-like layers from individual alternating layers of different materials.

BRIEF DESCRIPTION OF THE DRAWINGS

The drawings illustrate the best mode presently contemplated of carrying out the invention.

In the drawings.

DETAILED DESCRIPTION OF THE PREFERRED EMBODIMENT

Figure 1:
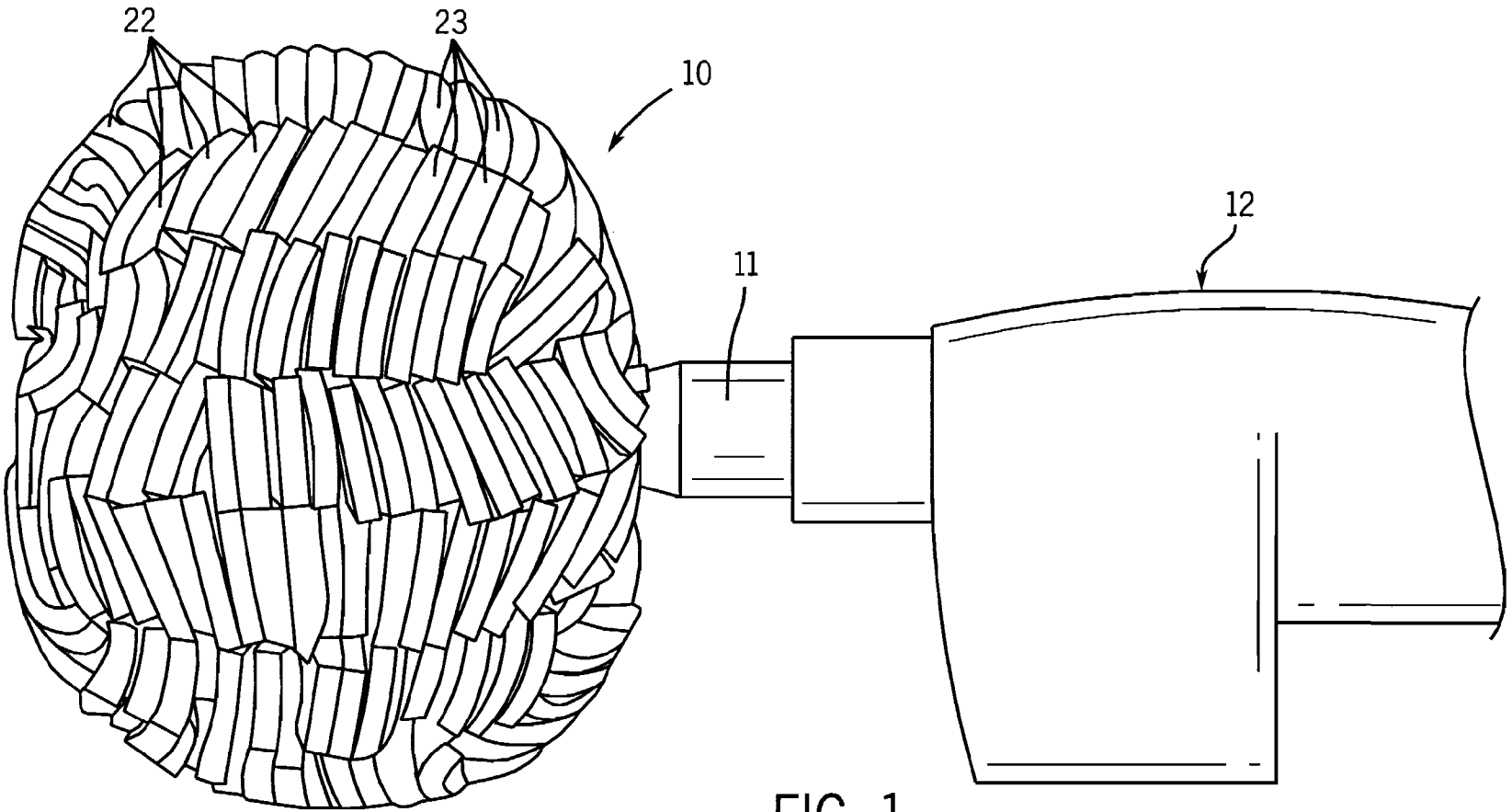
FIG. 1 is a side elevation view of the generally spherical foam buffing ball mounted on a rotary powered driving device.
Figure 3:
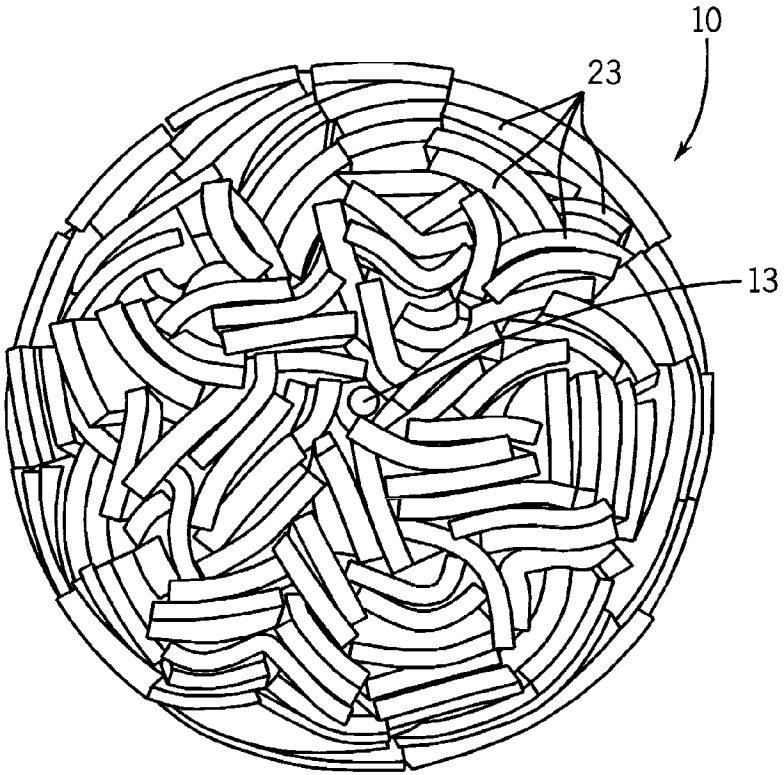
FIG. 3 is an end view of the buffing ball mounting end.
Figure 2:
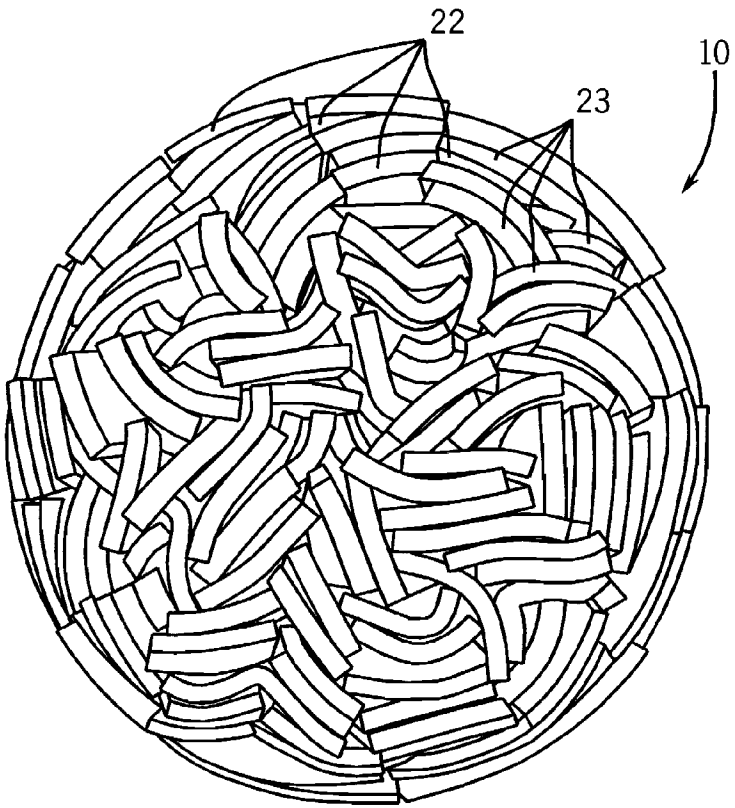
FIG. 2 is an end view of the buffing ball of FIG. 1 opposite its mounting end.

FIGS. 1-3 show a foam buffing and polishing ball 10 of the present invention. In FIG. 1, the ball is mounted on the chuck 11 of a driving tool 12 to rotate the ball about its rotational axis. In FIG. 3, the mounting end of the ball 10 is shown where a central drive shaft 13 is connected to the chuck 11 of the driving tool. The remainder of the compressing and fastening system used to shape the buffing and polishing ball 10 is contained within the interior of the ball and not normally visible.

The buffing ball 10 of the preferred embodiment of the present invention is made from a monolithic cylindrical foam body 14 which may be of an suitable polymeric foam material typically used in buffing and polishing pads for various surface finishing operations. For example, an open cell polyurethane foam which may be reticulated or unreticulated is one suitable and presently preferred material. The cylindrical foam body 14 includes a central through bore 15 on the axis of the cylindrical body. The bore 15 provides the axis for the compressing and fastening system to be described and also comprises the rotational axis of the completed ball 10.

Figure 5:
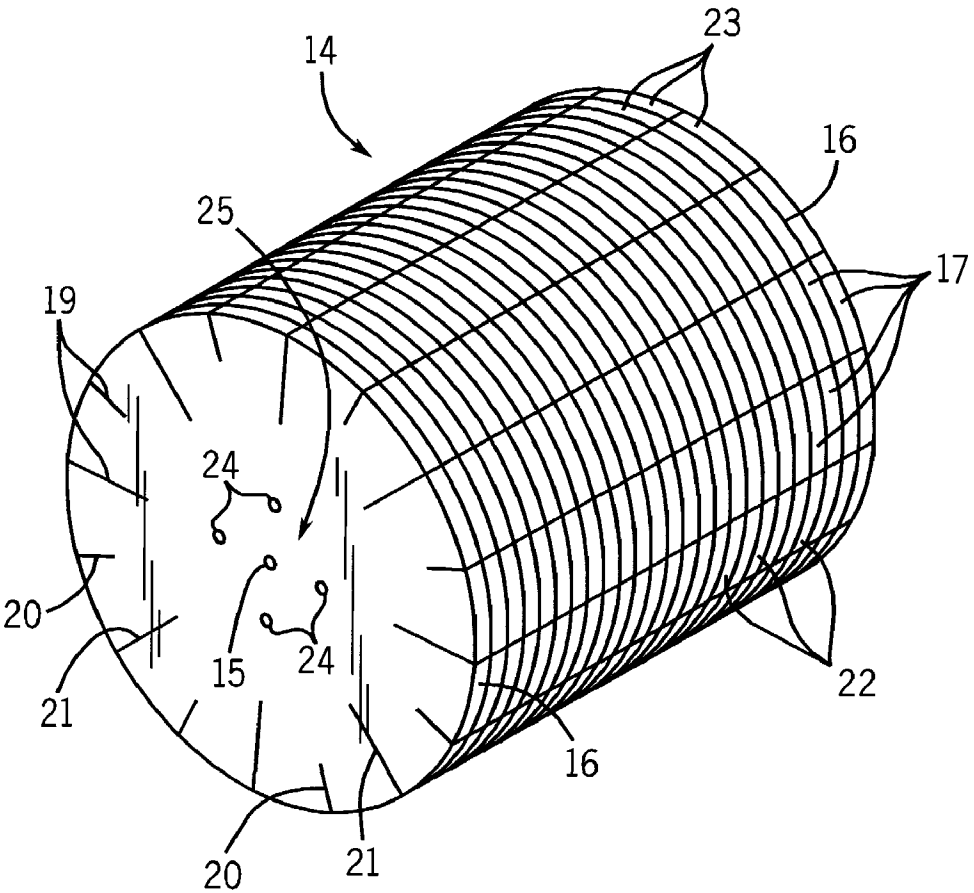
FIG. 5 is a perspective view of a cylindrical piece of polymeric foam showing generally the pattern of axially spaced parallel edge slits and circumferentially spaced radial edge slits.
Figure 6:
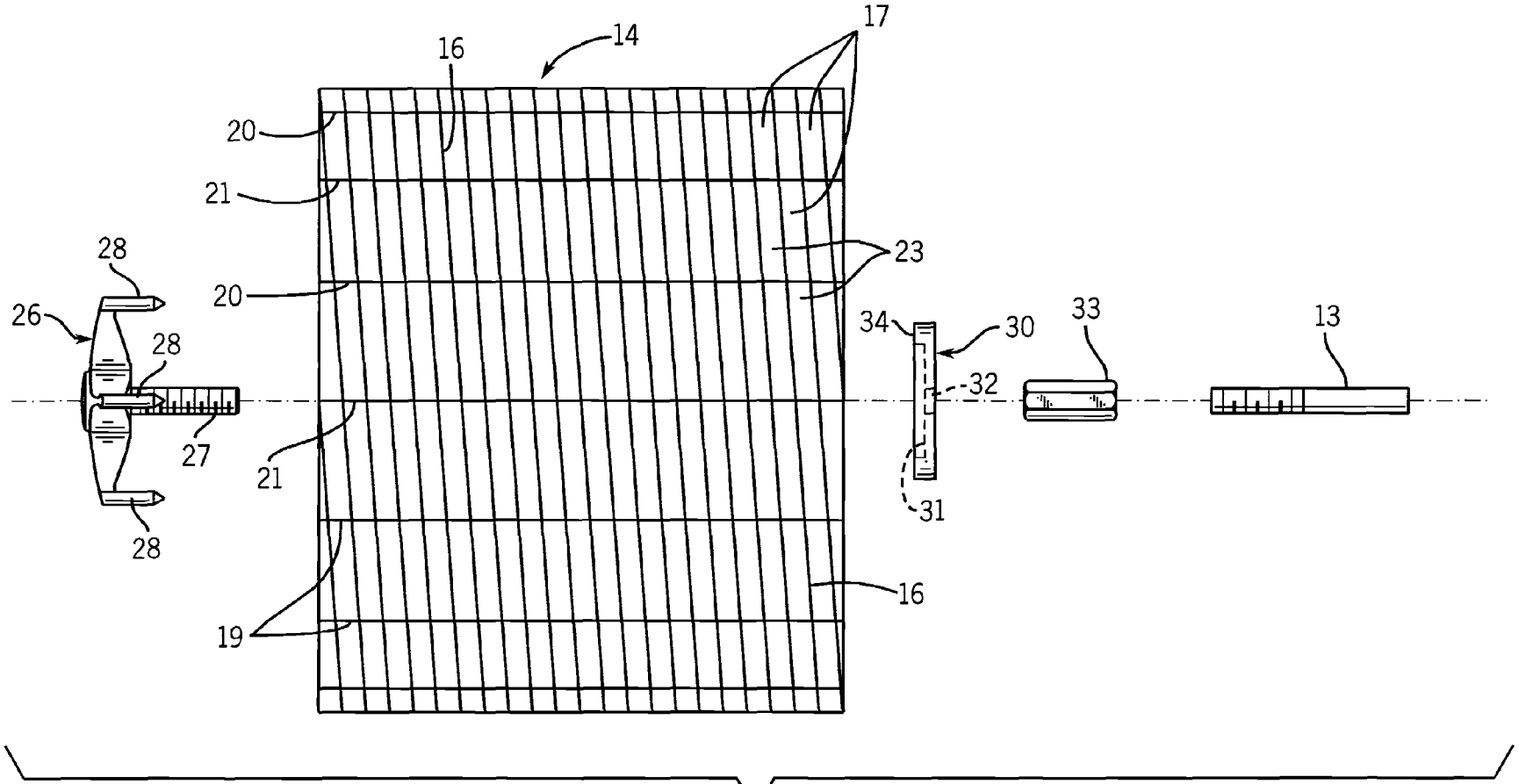
FIG. 6 is an exploded side elevation view of the cylindrical foam piece showing a slit pattern of the preferred embodiment and the compressing and fastening assembly used therewith.
Figure 9:
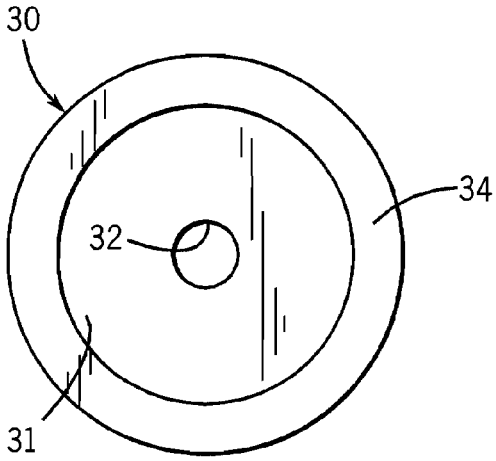
FIGS. 9-13 show the components of an alternate embodiment of the fastening system used to compress and clamp the foam piece in its final spherical shape and additionally showing a further embodiment.
Figure 10:
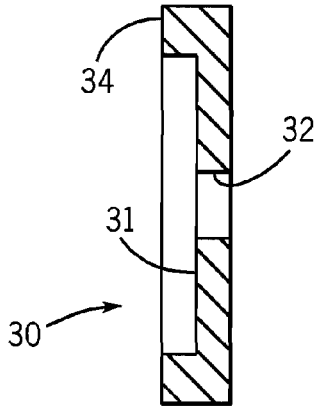

Referring particularly to FIGS. 5 and 6, the cylindrical foam body 14 is slit from an outside surface in a direction generally perpendicular to the axis of the bore 15 and is further slit from the outside surface on circumferentially spaced generally radially extending planes which include the rotational axis, and may be generally perpendicular to the first slits. Preferably, as best seen in FIG. 6, a single spiral slit 16 provides a slit that is generally perpendicular to the through bore 15 (which also coincides with the rotational axis of the polishing ball 10). The spiral slit 16 essentially provides a series of axially spaced foam layers 17. The pitch angle of the spiral slit 16 is very small such that, for example, in a cylindrical foam body 14 having an axial length of about 5 inches (about 125 mm), there may be about 25 layers 17. However, the pitch angle may be varied and, correspondingly, the number of foam layers. The spiral slit 16, in the preferred embodiment, extends to a depth of about half the radius of body 14, as shown in the slit termination line 18 in FIG. 8. However, the depth of the spiral slit 16 may be varied considerably.

Figure 8:
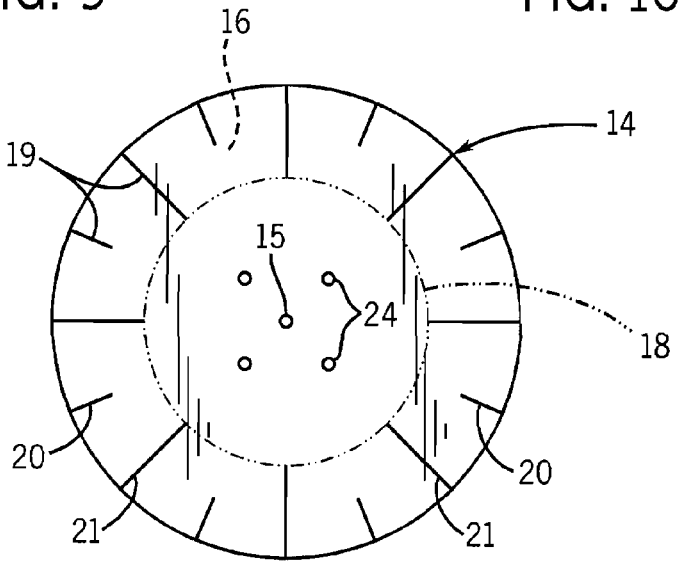
FIG. 8 is an end view of the cylindrical foam piece shown in FIG. 5.

The radial slits 19 which also extend inwardly from the outside surface of the foam body 14 preferably lie in planes that commonly intersect on the rotational axis defined by the bore 15. In the embodiment shown, there are 16 radial slits 19 which, if equally spaced, are 22.5° rotationally apart from one another. However, the number of radial slits may also vary considerably. As best seen in FIGS. 5 and 8, the radial slits 19 alternate circumferentially between shallow slits 20 and deep slits 21. With a foam body 14 having a diameter of about 6 inches (about 150 mm), the shallow slits 20 are cut to a depth of about ⅝ inch (about 16 mm) and the deep slits 21 to about the same depth as the spiral slit 16, namely, about 1.25 inches (about 30 mm). The resultant slit foam body 14 is provided with an outer cylindrical surface defined by the rectangular outer ends 23 of an array of foam fingers 22.

The spiral slit 16 is preferably made with a cutting blade brought into surface contact with the cylindrical body 14 as the body is rotated and simultaneously translated axially. The radial slits 19 (both the shallow slits 20 and the deep slits 21) are preferably made with a water jet cutter. The through bore 15 is also preferably made with the same water jet cutter, as are a series of four fastener bores 24 that are spaced radially from and surround the central through bore 15. The function of the fastener bores 24, as well as the through bore 15, will be described hereinafter.

Figure 4:
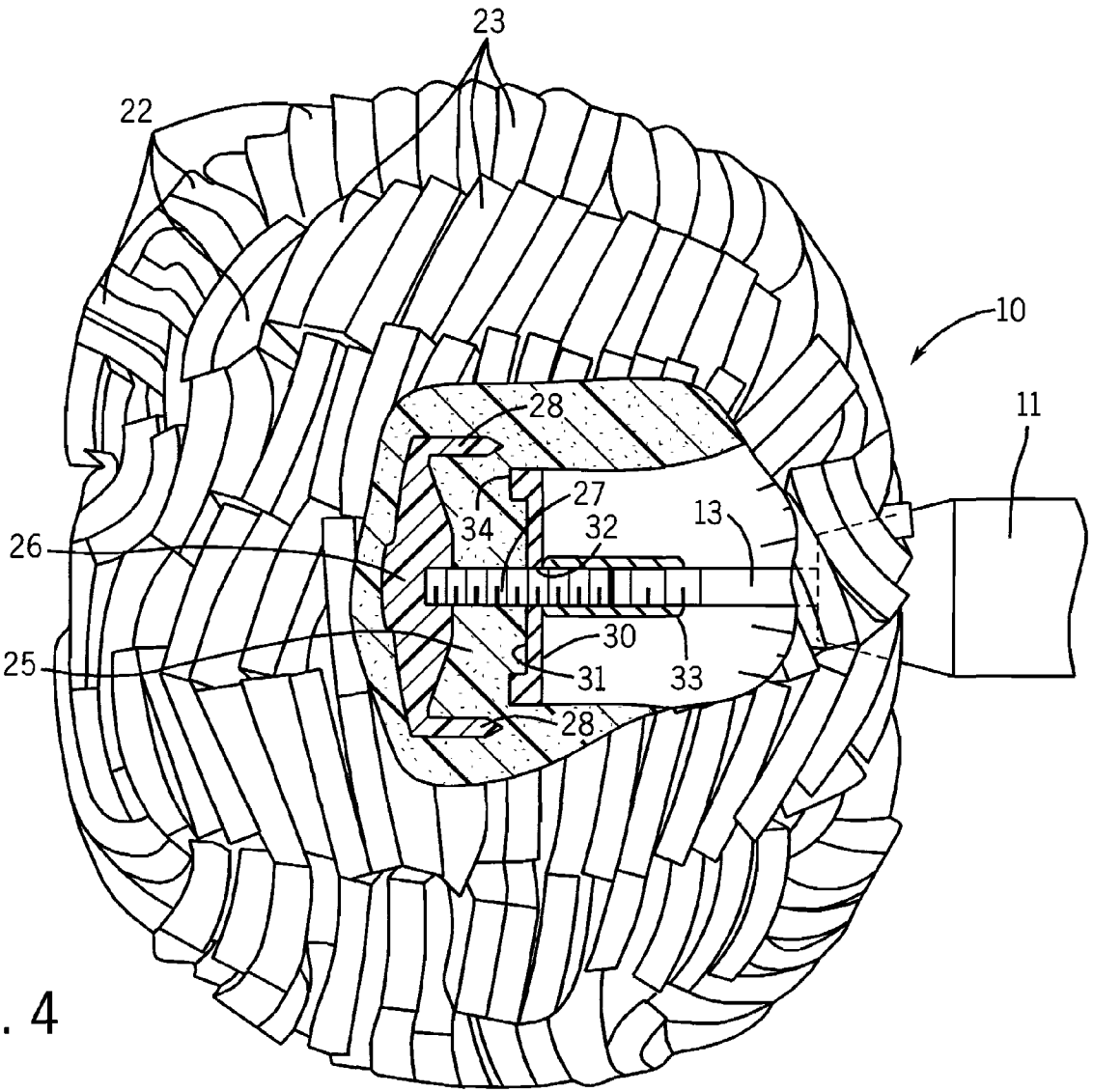
FIG. 4 is a side elevation view similar to FIG. 1 with portions shown in section to show the interaction of the components of the compressing and fastening system.
Figure 7:
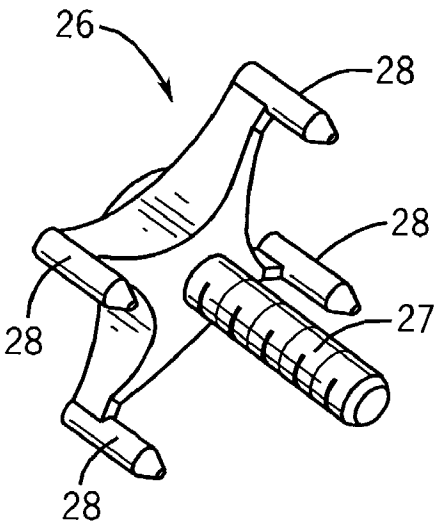
FIG. 7 is a perspective of the main driving head of the fastening system shown in FIG. 6.

Referring particularly to FIGS. 4, 6 and 7, the cylindrical foam body 14 is compressed axially and held in a manner that causes the center portion 25 of the body to be compressed and held while the foam fingers 22 are deformed in a manner such that the rectangular outer ends 23, though distorted somewhat, together assume a generally spherical shape. The fastening system includes a driving head 26 from which extend a center threaded stud 27 and a plurality of driving projections 28. The driving head 26 is pressed against one axial end of the foam body such that the threaded stud 27 enters the through bore 15 and the driving projections 28 enter the fastener bores 24. A bearing head 30 is pressed against the opposite axial end of the foam body 14 and includes an inner face comprising a bearing plate 31 and a center opening 32 which freely receives therethrough the threaded stud 27. When the driving head 26 and the bearing head 30 are pressed axially toward one another compressing the center portion 25 of the foam body therebetween, the threaded stud 27 passes through the center opening 32 in the bearing head, and an elongated nut 33 is threaded onto the stud 27 and against the back face of the bearing head 30 to hold the foam body in its compressed state and retain the spherical shape of the buffing ball 10, as best seen in FIG. 4.

The drive shaft 13 includes one threaded end that is then threaded into the opposite end of the elongated nut 33 until it bottoms on the end of the stud 27. The free unthreaded end of the drive shaft 13 is chucked into the driving tool 12, as previously described. The driving projections 28 on the driving head 26 bit into and firmly hold the compressed foam, allowing the ball 10 to be driven and held against the torque generated in a buffing and polishing operation. The inner face of the bearing head, comprising the bearing plate 31, may include a raised annular face 34 to help contain and resist radial movement of the compressed center portion 25 of the foam body 14.

Figure 11:
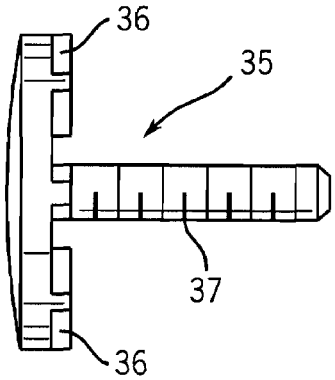
Figure 12:
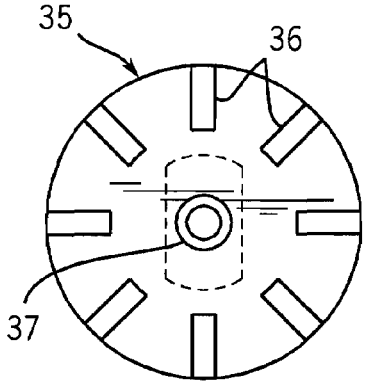
Figure 13:
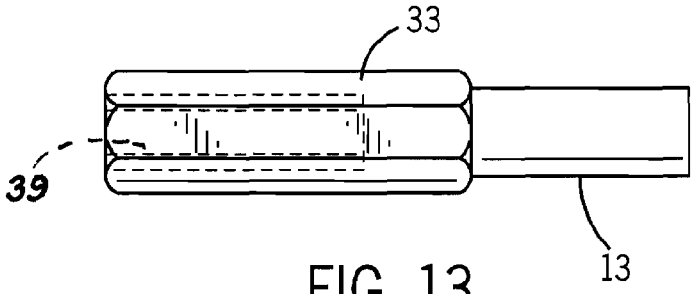

An alternate embodiment of the fastening system includes an alternate driving head 35, as shown in FIGS. 11 and 12, uses the same bearing head 30, elongated nut 33 and drive shaft 13 as described for and used in the preceding embodiment. The alternate driving head 35 includes a series of circumferentially spaced and axially extending drive lugs 36. The alternate driving head 35 also includes a center threaded stud 37 which passes through the center opening 32 in the bearing plate 31 for threaded attachment to the elongated nut 33, all in a manner similar to that previously described with respect to the preferred embodiment. The axially shorter drive lugs 36 of this embodiment are not believed to be as effective in holding the foam in its compressed state and transmitting the necessary drive torque to the ball 10 as are the driving projections 28 of the driving head 26 of the preferred embodiment.

Figure 14:
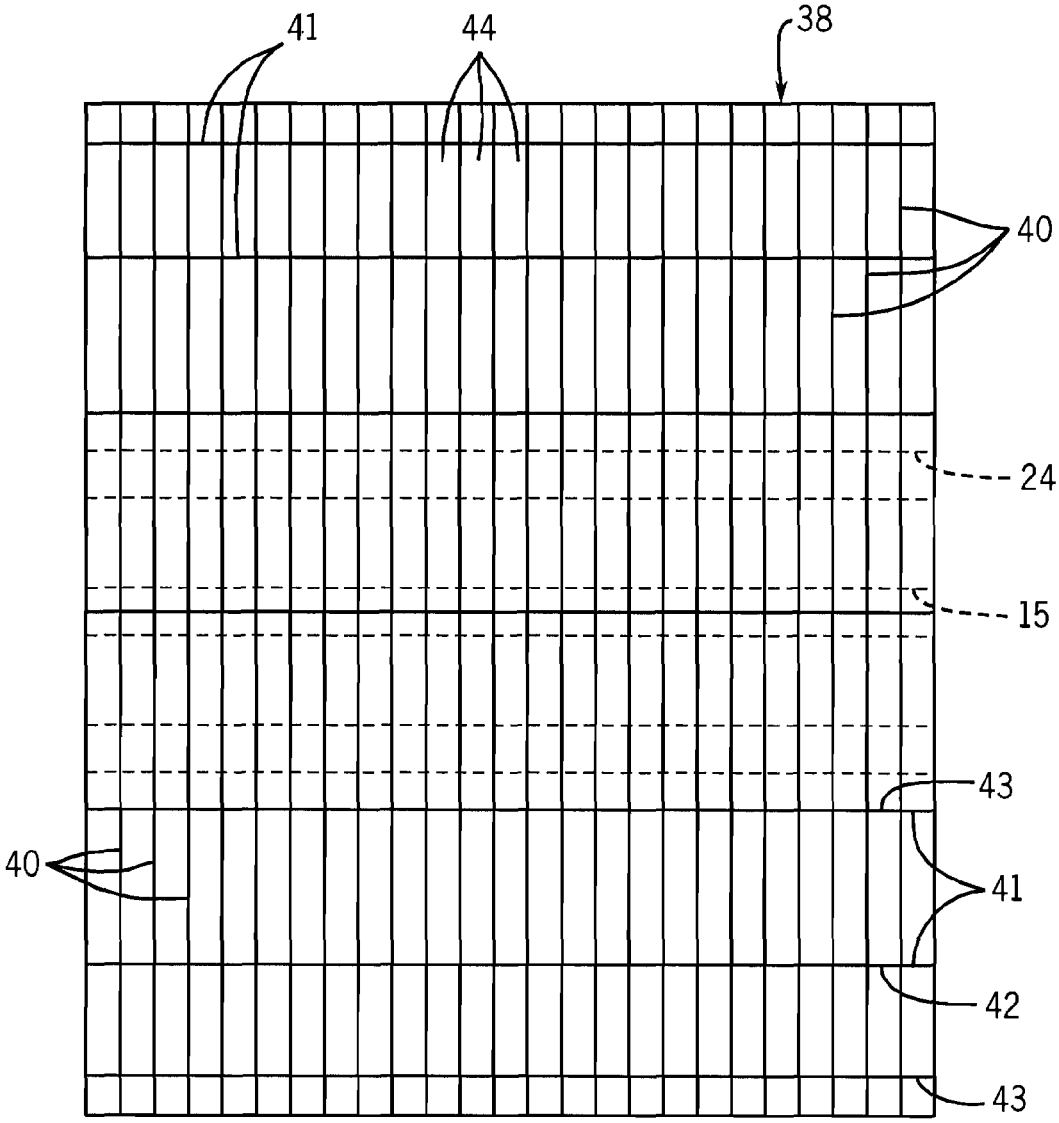
FIG. 14 is a side view of a multi-layer polymeric foam piece used in an alternate embodiment of the invention.
Figure 15:
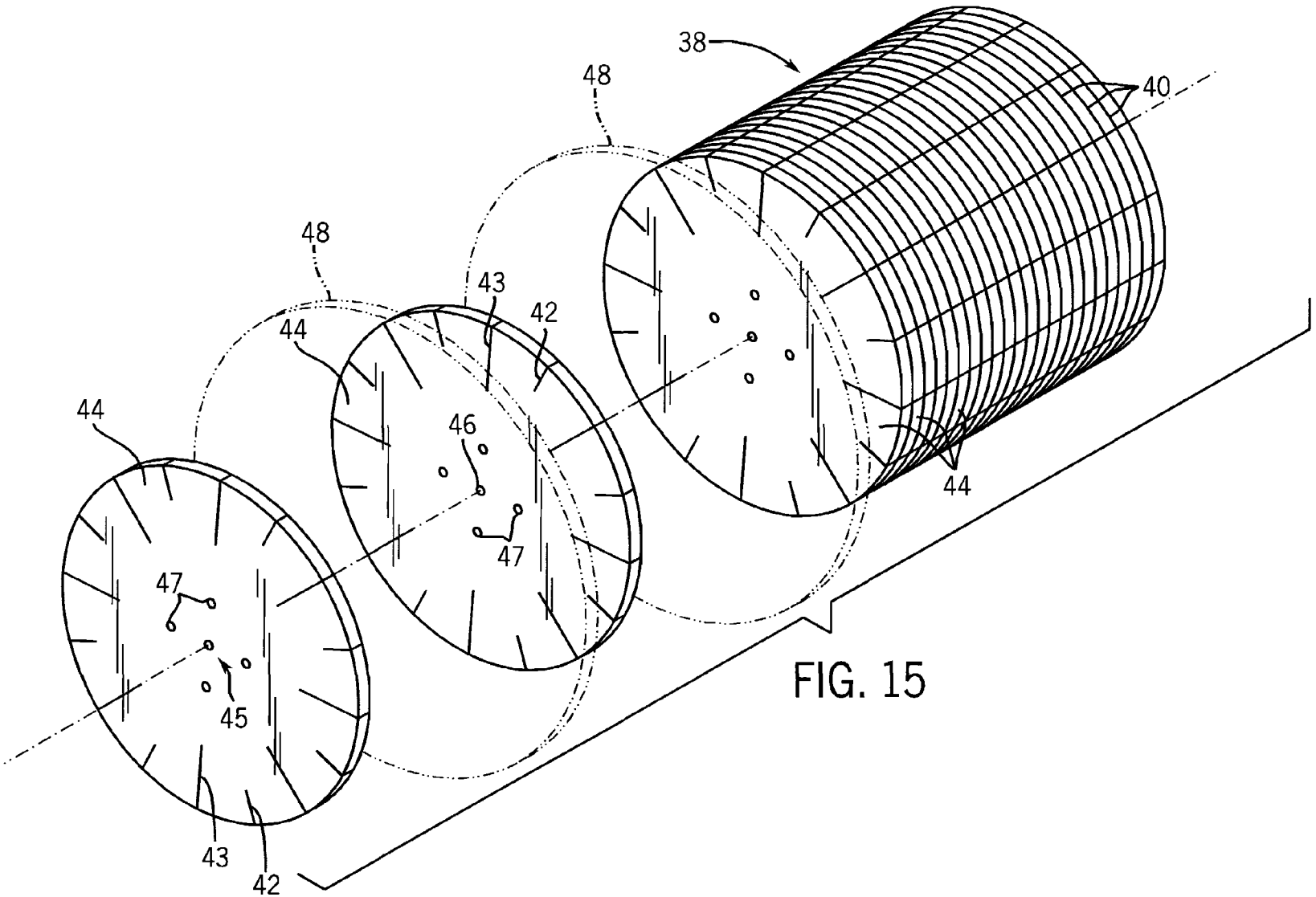
FIG. 15 is a perspective view of the multi-layer piece shown in FIG. 14.

Referring now to FIGS. 14 and 15, an alternate foam body 38 is shown. In this embodiment, separate multiple axially spaced slits 40 are utilized as opposed to a single spiral slit 16 of the preferred embodiment. The individual axially spaced slits 40 are made in planes that are truly perpendicular to the rotational axis of the cylindrical foam body 38. These slits 40 are also preferably formed with a suitable cutting tool (rotary or reciprocating), but must be made in a manner in which the tool is removed from the body and the body indexed axially with respect to the tool between slits. The alternate foam body 38 is also provided with radial slits 41 which, in a manner the same as the preferred embodiment, may alternate between shallow slits 42 and deep slits 43. The axially spaced slits 40 may also extend only a portion of the radial distance to the center of the cylindrical body, as described with respect to the previous embodiment. Also, either of the fastening systems previously described may be utilized to press and hold the foam body in its spherical operative shape.

As shown particularly in FIG. 15, the alternate foam body 38 may be made by extending the axially spaced slits 40 completely through the foam body to produce a series of individual foam layers 44. These layers may then be compressed along their center portions 45 to form the same spherical buffing ball shape and held in position with either of the previously described fastening systems. The center portion 45 may be provided with a center through bore 46 and fastener bores 47 as in the preferred embodiment. However, in this embodiment, it is preferred to use the driving head 26 of the preferred embodiment having the long driving projections 28. The driving projections 28 serve to hold the foam layers 44 together in a manner that helps prevent relative rubbing movement between the layers that is characteristic of the prior art device described above.

One advantage of utilizing an individually layered foam body as shown in FIG. 15 is that it is possible to use layers of other types of finishing material that is not compressible or only slightly compressible between foam layers 44, such that the foam layers provide the necessary compression to allow composite body to be formed into a spherical shape. In such an embodiment, as is shown in FIG. 15, the alternate finishing layers 48 may comprise non-foam material such as natural wool or non-woven synthetic materials. In this alternate embodiment, it is believed that at least about one-half the volume of the body in its uncompressed state should comprise compressible polymeric foam material. However, more or less foam material may be utilized, although the ability to form more or less truly spherical finishing ball will be reduced as the volume of foam material is reduced.

Applicant has also discovered that there are other porous compressible materials which may be substituted for the previously described polymeric foam material. Such porous compressible materials include non-woven polymeric fiber materials formed in compressible mats and optionally impregnated or coated with an abrasive material. These materials are typically formed in webs having a thickness of about ¼" (about 6 mm) and the porous web may be impregnated with an abrasive, such as aluminum oxide to provide a very aggressive finishing tool.

Figure 16:
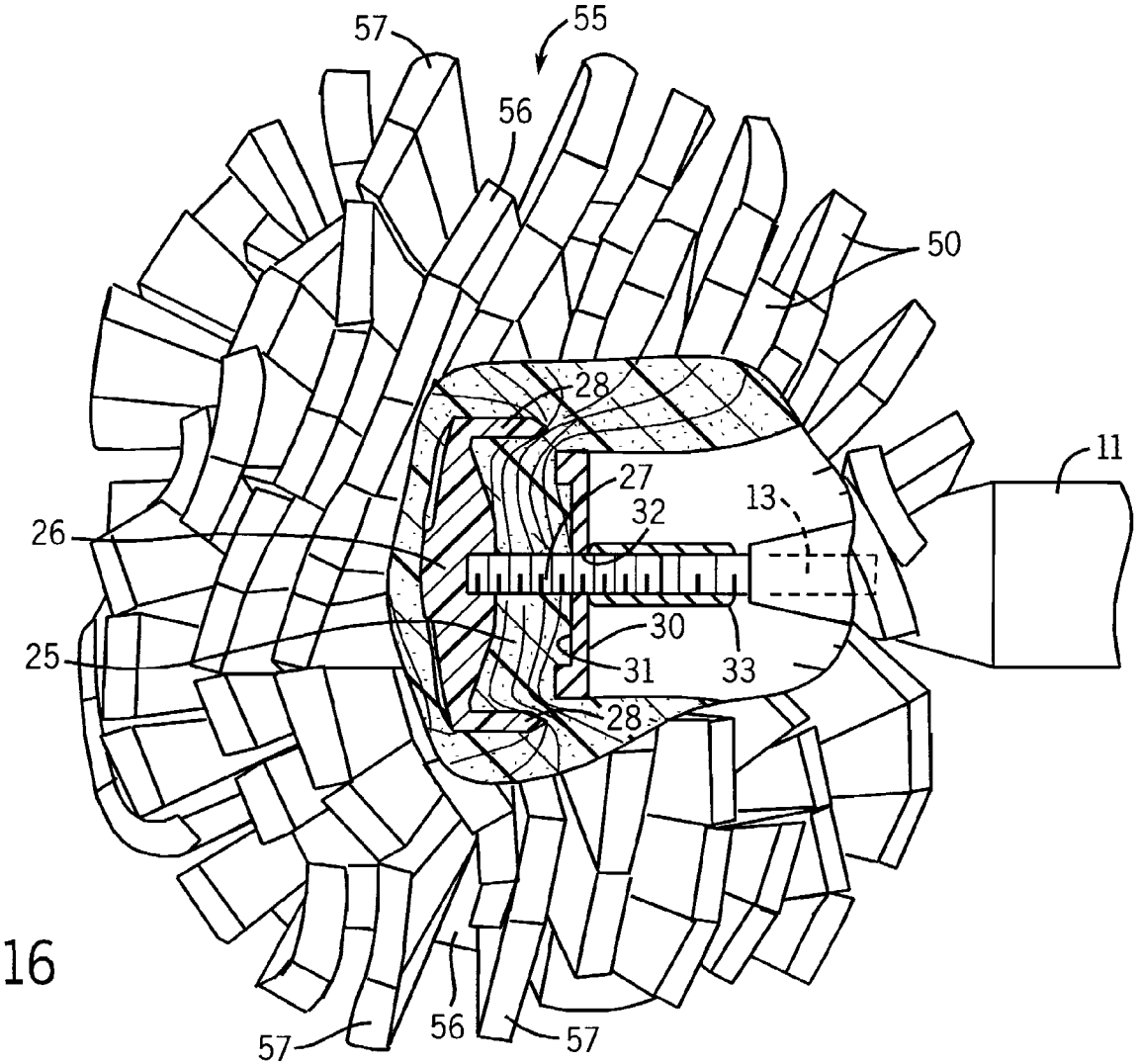
FIG. 16 is a view similar to FIG. 4 showing another embodiment of the invention using a stiffer, more abrasive and less compressible material.
Figure 17:
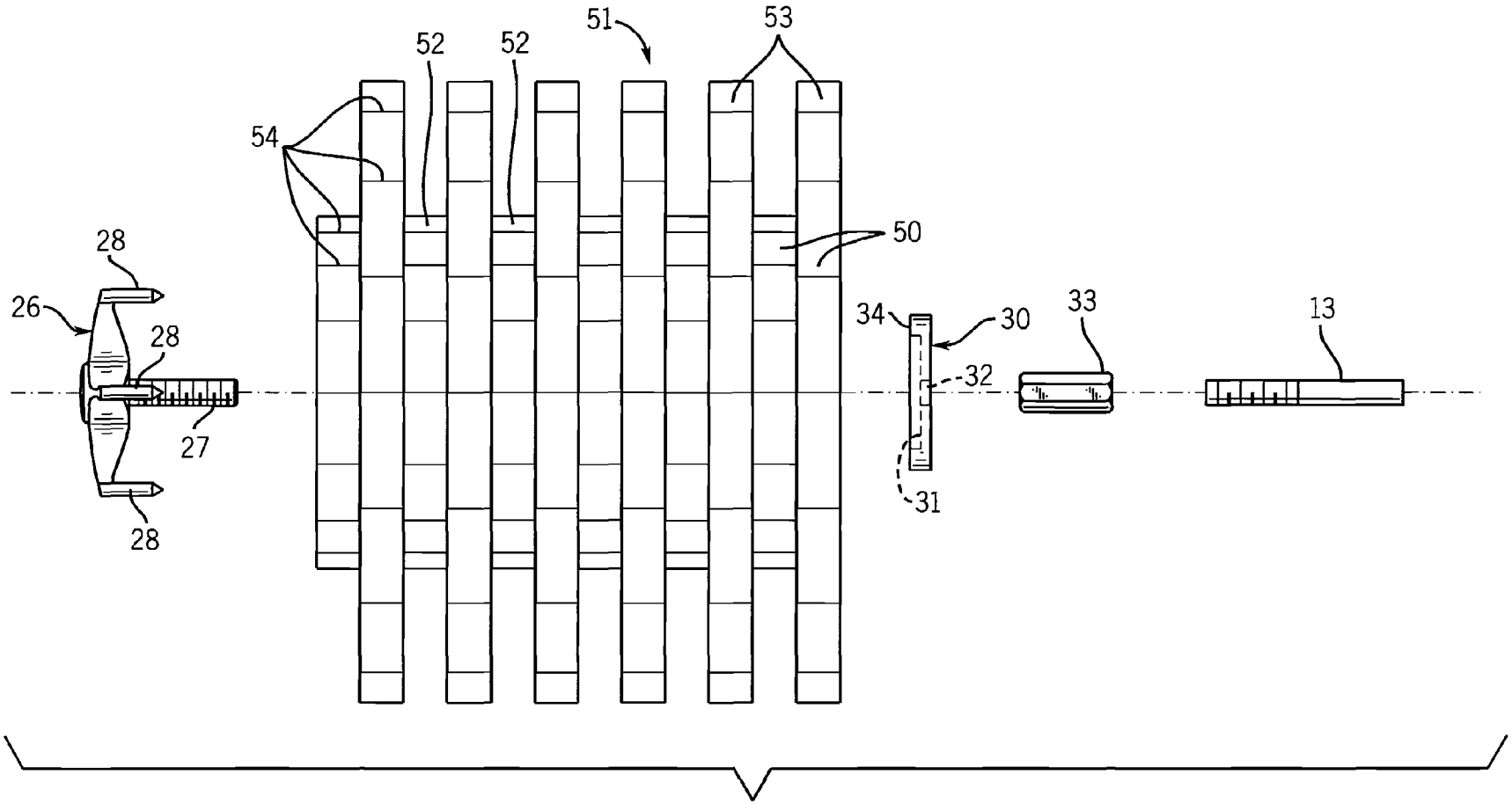
FIG. 17 is an exploded view side elevation view of the abrasive compressible material layers used to make the finishing ball of FIG. 16 and the compressing and fastening assembly used therewith.
Figure 18:
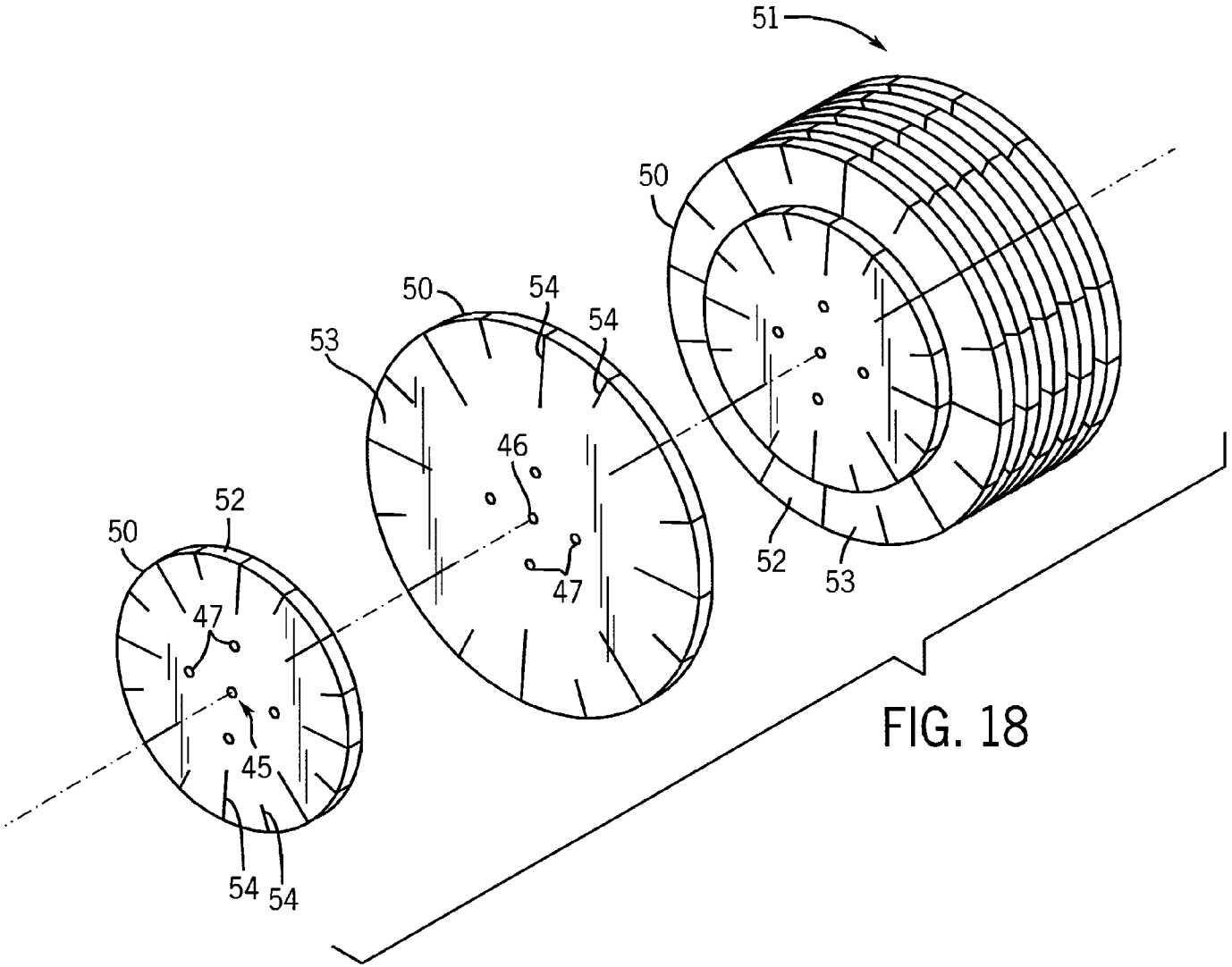
FIG. 18 is a perspective view of the multi-layer construction shown in FIGS. 16 and 17.

Referring to FIG. 18, one particularly useful embodiment is shown in its orientation before compression. A stack of disks 50 of a non-woven material (with or without added abrasive particles) is shown in perspective to illustrate how the stack 51 is assembled. The stack comprises alternating small diameter and large diameter disks 52 and 53, respectively. The disks 50 are each provided with circumferentially spaced edge slits 54 which may alternate in radial depth, as shown, or be of the same depth. Referring to FIG. 17, the stack of disks 50 is compressed axially and held together in the same way previously described, utilizing a driving head 26, bearing plate 31 and elongated nut 33. A drive shaft 13 is threaded into the free end of the nut 33 to complete the assembly. Although the non-woven porous fiber disks 50 are not as compressible as the polyurethane foam described in the preceding embodiments, it has been found that the disks 50 may nevertheless be compressed axially and held to form a generally spherical surface finishing ball 55 as shown in FIG. 16. Because of the variation in diameters of the small and large diameter disks 52 and 53, the resulting finishing ball 55 is characterized by a pattern of short fingers 56 and long fingers 57. It is believed that the variation in disk diameters not only provides a better shape for the finishing ball 55, but the variation in lengths of the fingers 56 and 57 provides a dual working surface. The long fingers 55 provide initial and primary contact with the surface being finished and, as the operator bears more heavily on the tool (or as the long fingers wear away), the short fingers 56 provide a secondary working surface. This is believed to provide both a better finishing surface and a longer tool life. Obviously, the least aggressive finishing ball 55 of this embodiment would include no impregnation with abrasive particles. Non-woven abrasive materials are available in varying levels of abrasiveness, but it has been found that disks made from the most abrasive materials currently available are too stiff when used alone, to be compressed sufficiently to form a good finishing ball.

However, even compressible materials that are too stiff to be compressed sufficiently to inherently form a sphere, as taught herein, may still be utilized with other more compressible materials, the combination providing an overall compressibility such that a finishing ball will still be formed. For example, alternating disks of highly abrasive, stiff and insufficiently compressible non-woven abrasive materials and polymeric foam materials can be used together to form a finishing ball. The non-woven abrasive layers utilize disks of larger diameter than the disks of the alternate polymeric foam material.

FIG. 16 shows, in partial section, the finishing ball 55 formed from disks 52 and 53 of non-woven abrasive material. The stack of disks 52 and 53, comprising 12 disks as shown in FIGS. 17 and 18, is approximately 4" (100 mm) in axial height. After compression to the spherical shape shown in FIG. 16, the stack of disks 50 has been compressed, between the driving head 26 and the bearing plate 31 to a thickness of about 0.3" (7.6 mm). The ratio of stack thickness to compressed thickness is about 10:1. The ratio of uncompressed to compressed thickness of the non-woven abrasive disks 50 was compared to a ball made from polymeric foam disks. Twenty-two layers of ¼" thickness each (about 6 mm) were compressed to about 0.3" (about 7.6 mm), resulting in a ratio of uncompressed to compressed thickness of about 18:1. Tests have shown that layers of compressible material having an uncompressed-to-compressed ratio as low as 5:1 may be successfully used to form a finishing ball in accordance with the present invention. In other words, resilient compressible materials which will inherently form a sphere when compressed in a central region and held in that position are suitable for use in accordance with the present invention.

Figure 19:
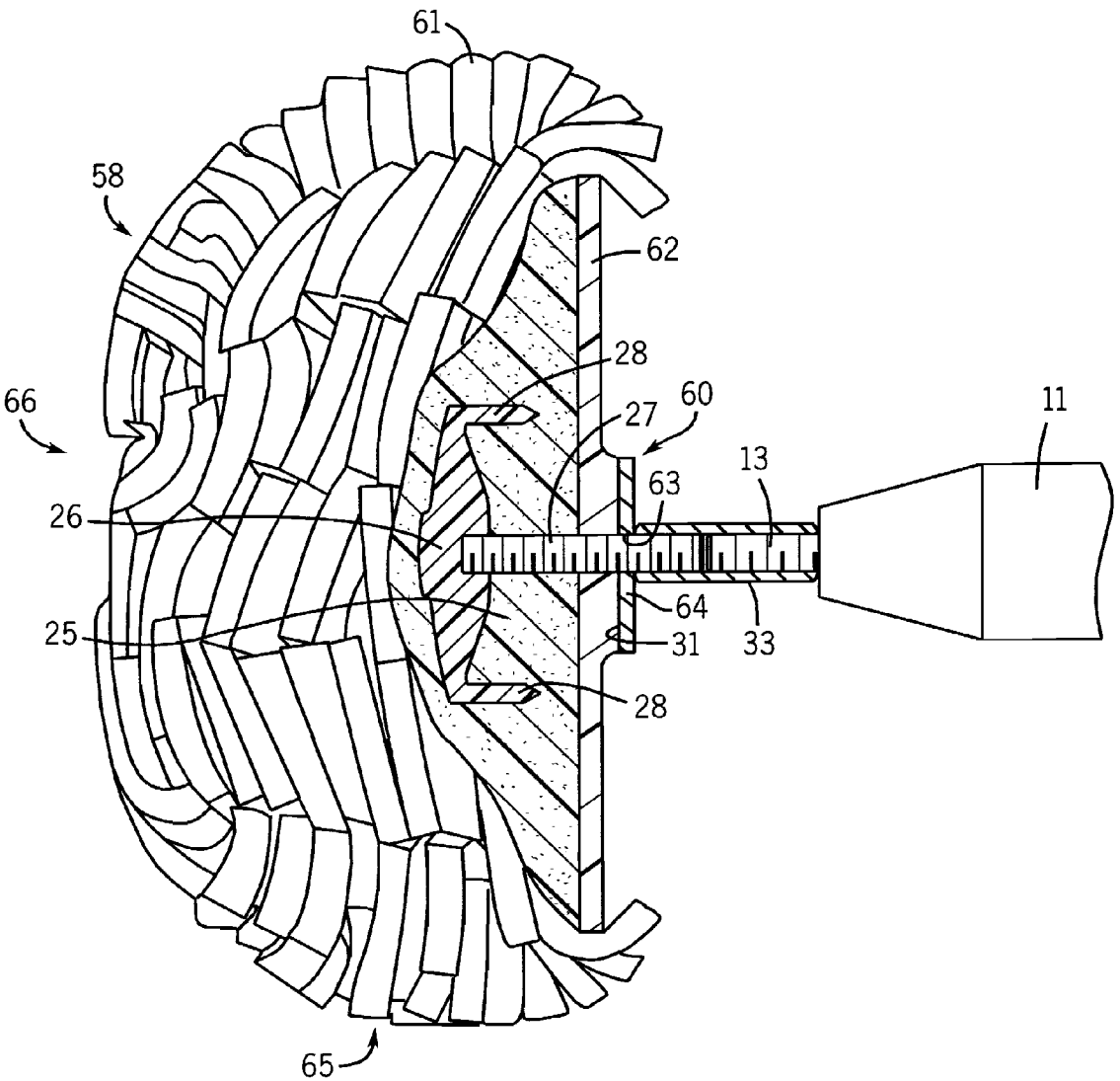
FIG. 19 is a side elevation view similar to FIG. 4 showing another embodiment utilizing a modified compression and fastening system.

In FIG. 19, there is shown yet another embodiment of the invention comprising a semispherical finishing ball 58. Because the portion of a more truly spherical finishing ball (such as shown in FIGS. 4 and 16) includes fingers of compressible material that surround the drive shaft 13 and the end of the chuck 11 to which the drive shaft is attached, the compressible material fingers in this region are of substantially less utility. This is because the chuck 11 and the driving tool 12 (FIG. 1) to which it is attached inhibit the placement of the compressible material fingers in the region surrounding the chuck and drive shaft into operative contact with the surface that is being worked on. In this alternate embodiment, a semispherical finishing ball 58 is formed without any foam fingers in the region where they have little utility and are unnecessary.

In the FIG. 19 embodiment, a modified fastening system 60 is used to compress and hold the center portion of a stack of compressible material layers or a body 61 of compressible material. The fastening system is the same as the system previously described, except that a large diameter bearing plate 62 is substituted for the previously described bearing plate 31. Otherwise, the fastening system is constructed and utilized in the same manner previously described. In particular, the uncompressed foam or other material body 61 (or stack of individual material disks) is compressed between the driving head 26, carrying the threaded stud 27, and the large diameter bearing plate 62. The bearing plate 62 has a center opening 63 through which the threaded stud 27 extends when the body is compressed and which is held closely spaced from the driving head 26 with the elongated nut 33. The drive shaft 13 is attached to the opposite axial end of the nut 33 in the same manner previously described.

The large diameter bearing plate 62 may be made of metal or plastic, the latter being the presently preferred material. A backing washer 64 may be placed against the large diameter plate 62, between the plate and the nut 33. Many alternate constructions of a suitable large diameter bearing plate are also possible in both metal and plastic constructions. The diameter of the large diameter bearing plate 62 may be about two-thirds the diameter of the body of compressible material. Thus, if the foam or other compressible material body has a diameter of about 6" (about 150 mm), the bearing plate 62 may have a diameter of about 4" (about 100 mm). By comparison, the smaller bearing plate 31, used in the previously described embodiments, may have a diameter approximately one-fifth the diameter of the foam body. However, the foregoing dimensions are merely examples and a wide range of bearing plate diameters could be used with a given compressible material body diameter.

As can be seen in FIG. 19, a substantial portion of the outer surface of the large diameter bearing plate 62 is exposed, as are the backing washer 64, nut 33 and drive shaft 13. However, the outer peripheral edge of the bearing plate 62 is surrounded by a number of layers of the slit compressible material 61 which tend to wrap around the edge of the plate as shown. This provides full utility for the semispherical finishing ball, permitting the operator to utilize the side surface 65 of the ball 58 and the contiguous surface formed by the foam fingers all the way to the axial outer end 66. Any of the compressible materials previously described which permit the fingers to inherently assume a spherical shape when compressed, may be utilized in this embodiment as well.

When alternating disks of two different materials are used, it is possible to select one material that is substantially uncompressible or only slightly compressible. For example, thin layers of an uncompressible abrasive finishing cloth may be alternated with polymeric foam or other highly compressible materials and formed into a finishing ball in accordance with the method of the present invention.

Other materials which have been found to be suitable include natural sponge material and synthetic sponge material. These materials are inherently much more stiff and hard in their dry state, but if wetted before compression, they will also inherently form into a spherical shape. Thus, a block of natural or synthetic sponge material may be formed in a manner shown in FIG. 5, 6 or 14 with an appropriate slit pattern and compressed as described hereinabove to form a spherical ball suitable for many cleaning operations.

The term "generally spherical" as used to describe the embodiments of FIGS. 1-18 is also intended to include the truncated sphere represented by the semispherical ball 58 of the FIG. 19 embodiment. The compressible materials, the manner in which they are compressed, and the particular fastening system used to maintain the generally spherical shape are all intended to be included in the apparatus and method of the present invention by which the substantially or generally spherical shape is attained by the unique compression and holding system described.

What is claimed is:

1. A method of making a rotary driven surface finishing ball of compressible material, comprising the steps of:

forming a body of compressible material from multiple disk-like layers separated at least partially from an outside surface radially inwardly in planes generally perpendicular to a rotational axis, slitting said layers on circumferentially spaced planes extending generally radially from said outside surface of said layered body to define a plurality of fingers, and compressing and holding a center portion of said layered body in a direction along said axis such that the uncompressed outer ends of said fingers define a generally spherical ball, said compressing and holding step including:

inserting a threaded stud having a driving head on one end along said axis through the layered body from one outer surface, pressing a bearing head having a threaded connector along the rotational axis from an opposite outer surface toward the threaded stud, threadably engaging the stud to adjustably compress the center portion between the driving head and the bearing head; and, continuing the threadable engagement of the bearing head toward the driving head until a level of compression is attained that is sufficient to hold the center portion in the compressed state and the body as a generally spherical ball, transmit the necessary drive torque to the ball, and substantially prevent movement within the compressed center portion or between the center portion and one of the heads.

2. The method as set forth in claim 1 comprising the step of forming the disk-like layers from separate layers of at least two different materials of different compressabilities.

3. The method as set forth in claim 1 comprising the steps of forming the disk-like layers from separate layers or at least two different diameters.

4. The method as set forth in claim 1 comprising the steps of forming the disk-like layers from separate layers of at least two different materials.

5. A method of making a rotary driven surface finishing ball of compressible material, comprising the steps of:

forming a body of compressible material from multiple disk-like layers separated at least partially from an outside surface radially inwardly in planes generally perpendicular to a rotational axis, slitting said layers on circumferentially spaced planes extending generally radially from said outside surface of said layered body to define a plurality fingers, and compressing and holding a center portion of said layered body in a direction along said axis such that the uncompressed outer ends of said fingers define a generally spherical ball, said compressing and holding step including:

inserting a threaded stud threaded having a driving head on one end along said axis through the layered body from one outer surface, pressing a bearing head having a threaded connector along the rotational axis from an opposite outer surface toward the threaded stud, threadably engaging the stud to adjustably compress the center portion between the driving head and the bearing head;

providing the driving head with axially extending driving projections spaced circumferentially around and radially outwardly from the axis of the stud; and, continuing the threadable engagement of the bearing head toward the driving head until a level of compression is attained that is sufficient to hold the center portion in the compressed state and the body as a generally spherical ball, transmit the necessary drive torque to the ball, and substantially prevent movement within the compressed center portion or between the center portion and one of the heads.

6. The method as set forth in claim 5 comprising a step of forming the disk-like layers from separate layers of at least two different materials of different compressabilities.

7. The method as set forth in claim 5 comprising the steps of forming the disk-like layers from separate layers or at least two different diameters.

8. The method as set forth in claim 5 comprising the steps of forming the disk-like layers from separate layers or at least two different materials.

* * * * *